US011268313B2

(12) United States Patent
Terenzi

(10) Patent No.: US 11,268,313 B2
(45) Date of Patent: Mar. 8, 2022

(54) COMPACT HINGE DEVICE

(71) Applicant: C.M.I. CERNIERE MECCANICHE INDUSTRIALI S.R.L., Valsamoggia (IT)

(72) Inventor: Emanuele Terenzi, Rieti (IT)

(73) Assignee: C.M.I. Cerniere Meccaniche Industriali S.R.L.

( * ) Notice: Subject to any disclaimer, the term of this patent is extended or adjusted under 35 U.S.C. 154(b) by 0 days.

(21) Appl. No.: 17/264,802

(22) PCT Filed: Jul. 17, 2019

(86) PCT No.: PCT/EP2019/069233

§ 371 (c)(1),
(2) Date: Jan. 30, 2021

(87) PCT Pub. No.: WO2020/025321

PCT Pub. Date: Feb. 6, 2020

(65) Prior Publication Data

US 2021/0293070 A1 Sep. 23, 2021

(30) Foreign Application Priority Data

Jul. 30, 2018 (IT) ..... 102018000007641

(51) Int. Cl.
*E05F 1/08* (2006.01)
*E05F 3/20* (2006.01)
(Continued)

(52) U.S. Cl.
CPC ..... *E05F 3/20* (2013.01); *E05D 3/14* (2013.01); *E05F 1/1276* (2013.01); *E05F 3/10* (2013.01);
(Continued)

(58) Field of Classification Search
CPC ..... E05Y 2900/20; E05Y 2900/30; E05Y 2900/606; E05Y 2900/308;
(Continued)

(56) References Cited

U.S. PATENT DOCUMENTS 9,121,211 B1 9/2015 White et al.
2010/0148646 A1* 6/2010 Bettinzoli ..... E05F 5/10 312/326
(Continued)

FOREIGN PATENT DOCUMENTS

CN 102400623 B * 7/2014 ..... E05F 1/1276
EP 3179023 A1 * 6/2017 ..... E05F 1/1276
(Continued)

OTHER PUBLICATIONS

International Search Report, Application No. PCT/EP2019/069233, dated Oct. 17, 2019, 4 pages.
(Continued)

*Primary Examiner* — Chuck Y Mah
(74) *Attorney, Agent, or Firm* — Ware, Fressola, Maguire & Barber LLP

(57) ABSTRACT

First (3) and second (5) elements are mutually connected by a hinge pin (7). A transmission element (44) is interposed between the second element (5) and a cradle (53) end and includes elastic means (27) having an end connected to the cradle (53) end opposite to transmission element (44). An elongated first box member (41) contains, at least partially, the transmission element (44), the connected cradle (53) and the elastic means (27) whose end opposite to the cradle (53) is fixed to the first box member (41) transmitting the elastic closing force of the elastic means (27) to the second element (5). The cradle (53) contains a damper (57), each end of which has a respective transverse pin (58) whose ends slide
(Continued)

in respective slots (54) formed in the cradle (53) and in respective slots (42) formed in the first box member (41).

10 Claims, 7 Drawing Sheets

(51) Int. Cl.
*E05D 3/14* (2006.01)
*E05F 1/12* (2006.01)
*E05F 3/10* (2006.01)

(52) U.S. Cl.
CPC ... *E05Y 2201/416* (2013.01); *E05Y 2201/638* (2013.01); *E05Y 2900/20* (2013.01); *E05Y 2900/308* (2013.01)

(58) Field of Classification Search
CPC ..... E05Y 2201/416; E05Y 2201/638; E05D 11/1064; E05D 7/10; E05D 7/1055; E05D 7/1022; E05D 7/105; E05F 1/12; E05F 1/1276; E05F 3/10; E05F 3/20; E05F 5/02; Y10T 16/5383
See application file for complete search history.

(56) References Cited

U.S. PATENT DOCUMENTS

| | | | | |
|---|---|---|---|---|
| 2010/0281650 | A1* | 11/2010 | Kleemann | E05F 5/02 16/64 |
| 2016/0273777 | A1* | 9/2016 | Kim | E05F 5/02 |
| 2018/0073291 | A1* | 3/2018 | Vanini | E05F 5/00 |
| 2019/0353353 | A1* | 11/2019 | White | E05D 3/12 |

FOREIGN PATENT DOCUMENTS

| | | | | |
|---|---|---|---|---|
| WO | 2009/033960 | A1 | 3/2009 | |
| WO | WO-2013133774 | A1 * | 9/2013 | F24C 15/023 |
| WO | 2017/097633 | A1 | 6/2017 | |
| WO | 2019/121391 | A1 | 6/2019 | |

OTHER PUBLICATIONS

Written Opinion of the International Searching Authority, Application No. PCT/EP2019/069233, dated Oct. 17, 2019, 6 pages.

* cited by examiner

FIG.7
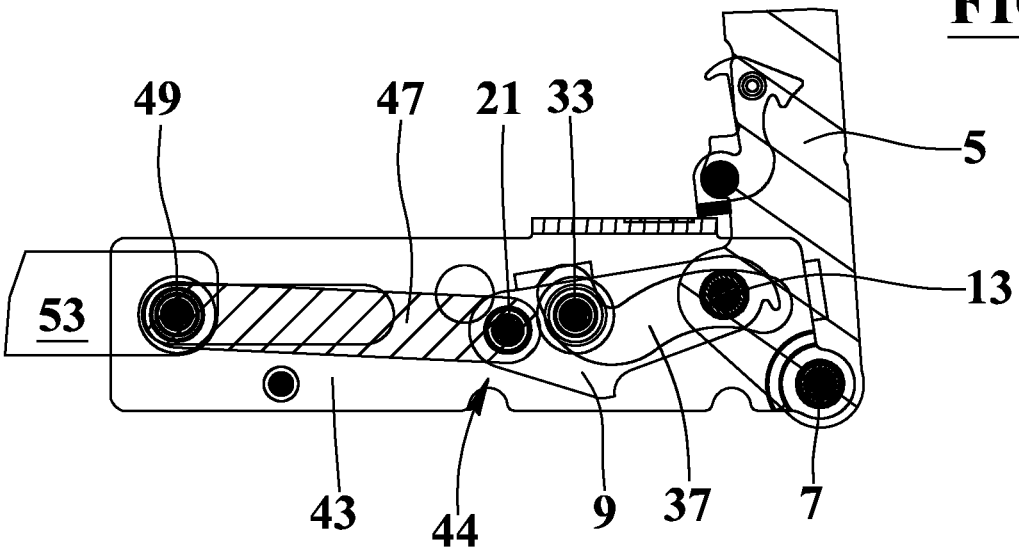
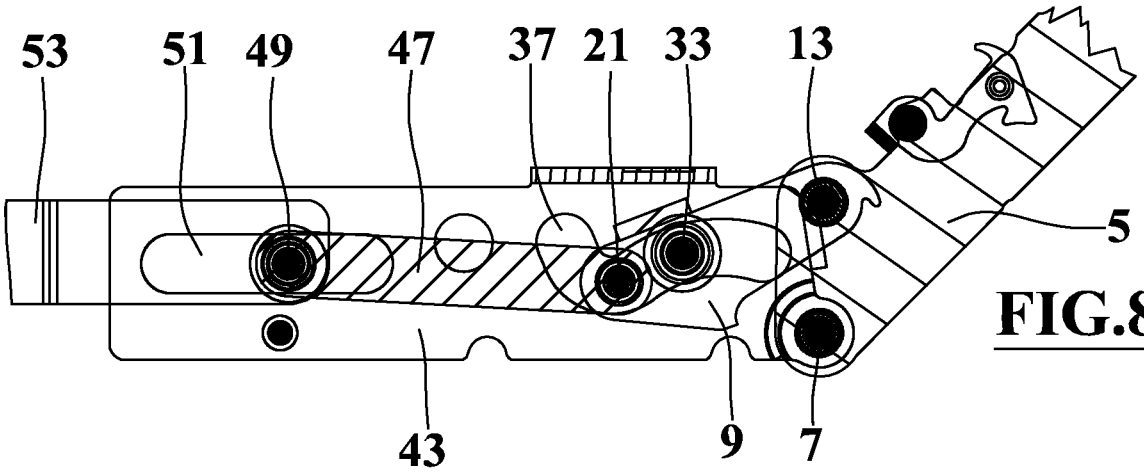
FIG.8
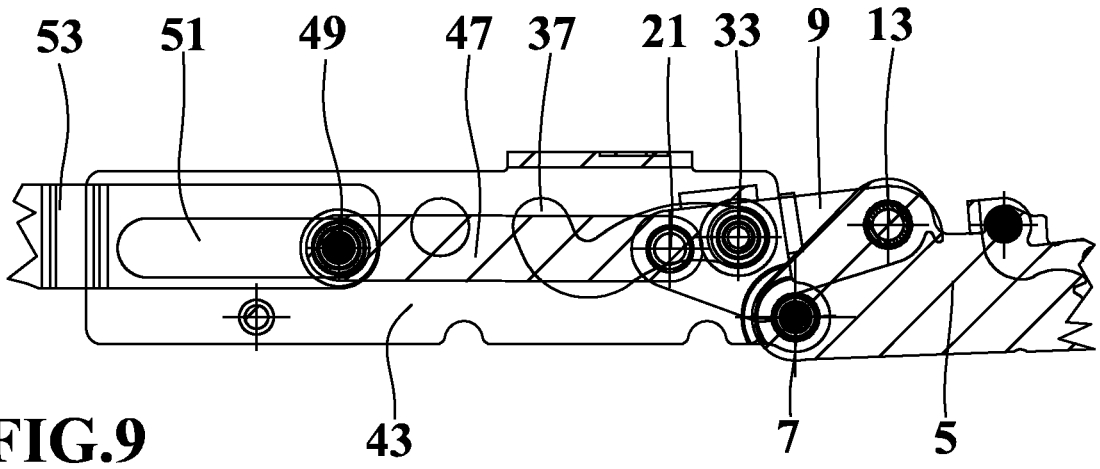
FIG.9

FIG.13
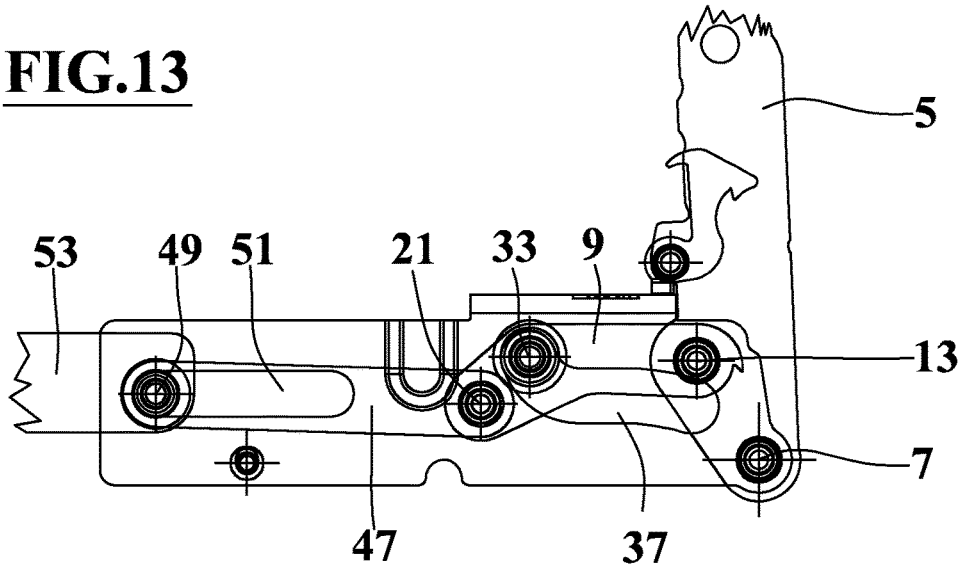
FIG.14
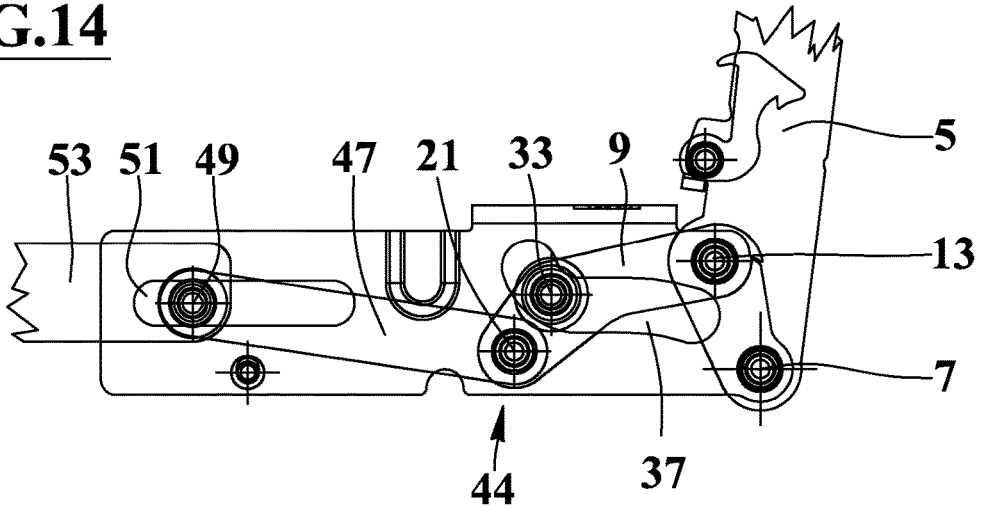
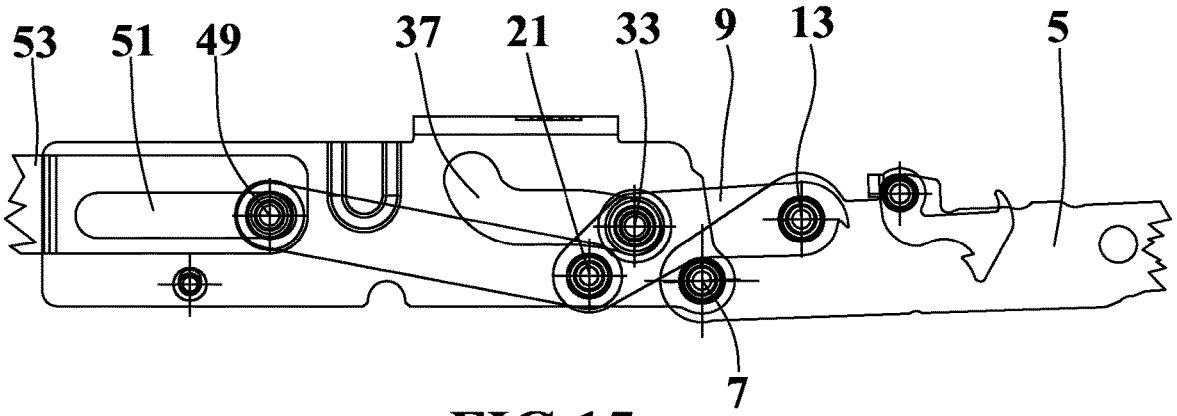
FIG.15

COMPACT HINGE DEVICE

TECHNICAL FIELD

The present invention relates to the technical field concerning the hinges for household appliances, furniture and the like and refers to a compact hinge device, balanced and with one or more intermediate metastable positions.

PRIOR ART

There are known hinges equipped with weight balancing springs and springs acting on sliding blocks or rollers constrained to the fixed hinge member for elastically pressing them against profile cams formed in the edge of a movable hinge member where such cams are profiled with metastable housing recesses of the rollers in certain intermediate or end positions of the rotation of the movable members of the hinges.

The earlier documents No. WO2017/097633 A1 and No. U.S. Pat. No. 9,121,211 B1 disclose a compact hinge in which the force of a spring is applied between the rotating elements of the hinge by means of a rocker arm having a median pin slidable into a cam profile of a shaped slot fixed or formed in one of the elements.

A drawback of these known hinges consists in the fact that they are bulky and unsuitable for certain uses, for example, they are not suitable for domestic or artisan ovens because of their dimensions.

Another drawback of said known hinges consists in the fact that they are complex and therefore expensive and subject to malfunctions or failures.

DISCLOSURE OF THE INVENTION

An object of the present invention is to propose a compact hinge device, balanced and with one or more intermediate metastable positions also suitable for installations with limited space for housing the hinge device, such as for example domestic ovens.

Another object is to propose a hinge device suitable for various equipment, furniture and applications.

BRIEF DESCRIPTION OF THE DRAWINGS

The characteristics of the invention are below highlighted with particular reference to the accompanying drawings in which:

FIGS. 7-9 show partial views and sectioned by a longitudinal plane of the device of FIG. 1, in which some parts have been removed to better highlight others, in closed conditions partially open and totally open;

FIGS. 13-15 show schematic and partial views of some elements of the variant of FIG. 10 at respective complete closure, initial opening and complete opening conditions.

BEST MODE TO CARRY OUT THE INVENTION

Figure 1:
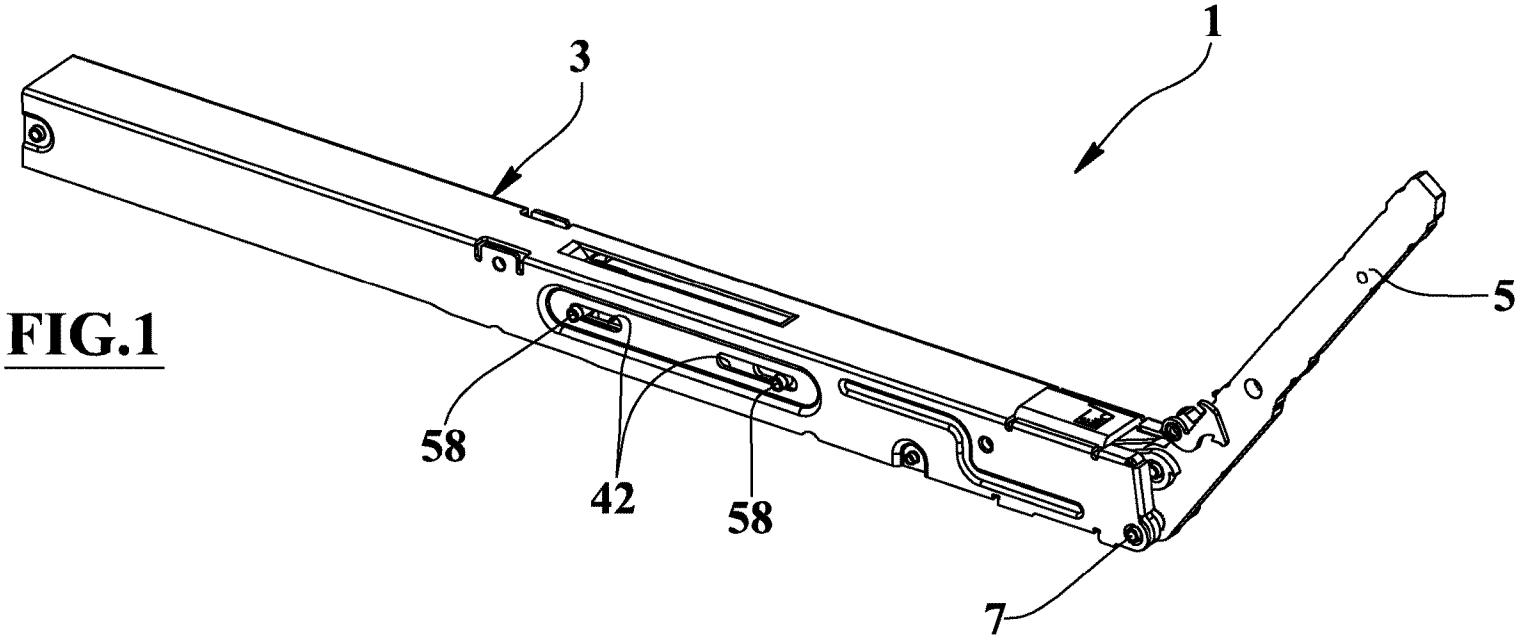
FIGS. 1 and 2 show respectively axonometric and side views of the compact hinge device subject of the present invention.
Figure 2:
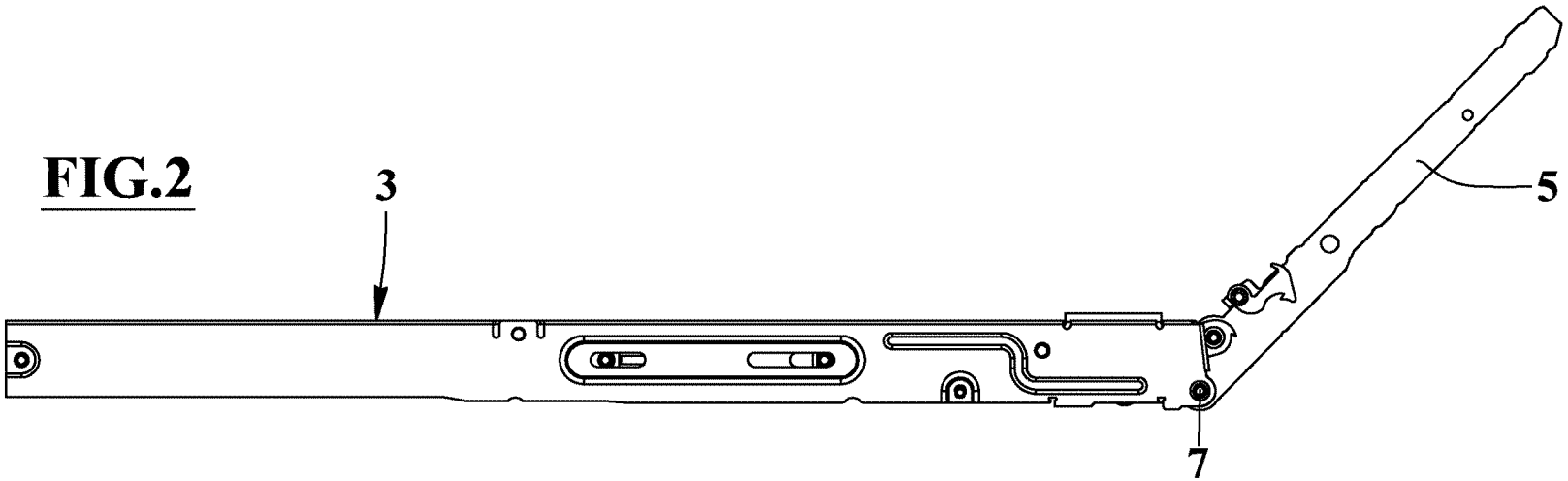
Figure 3:
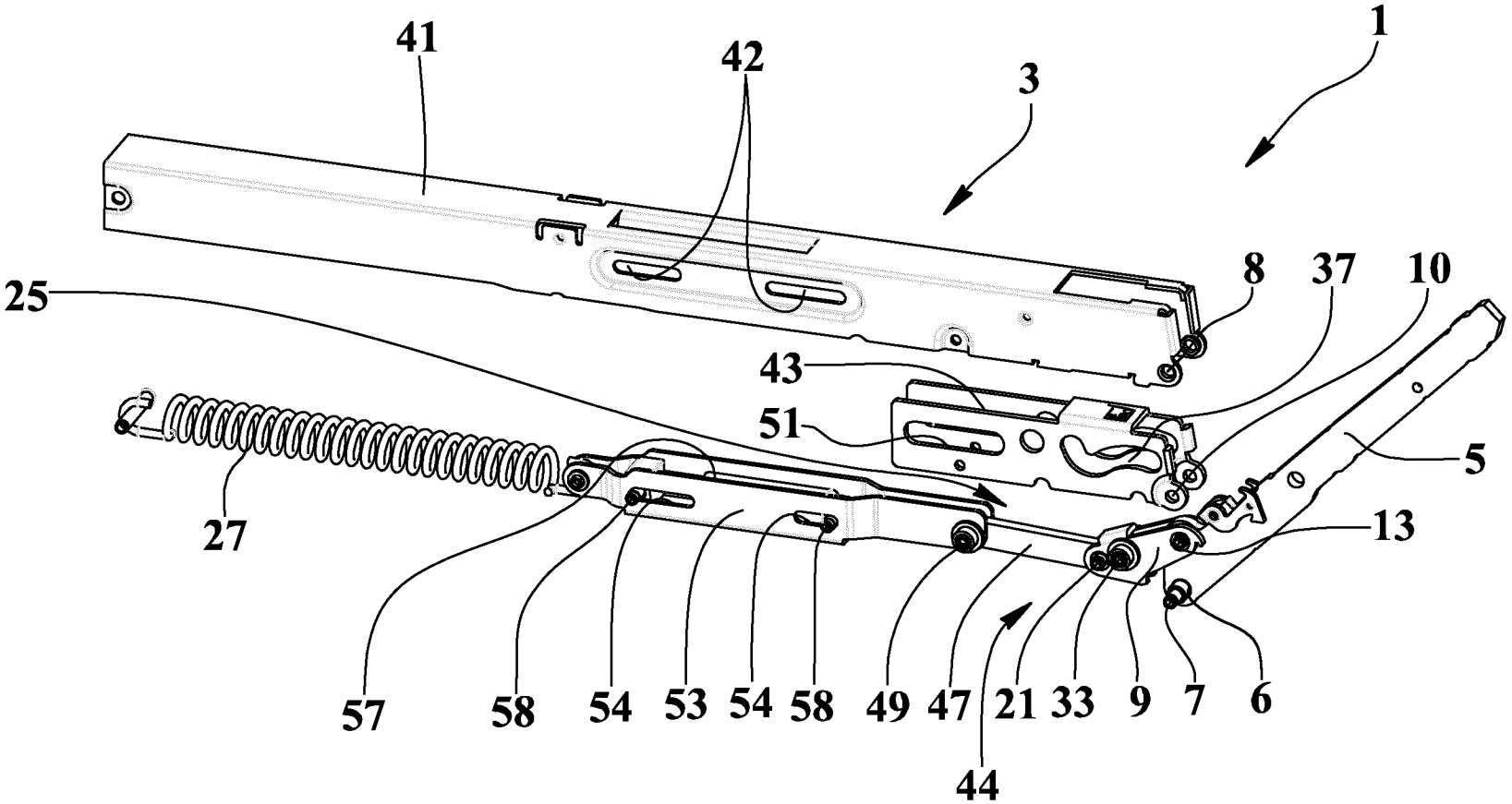
FIG. 3 shows a partially exploded view of FIG. 1.
Figure 4:
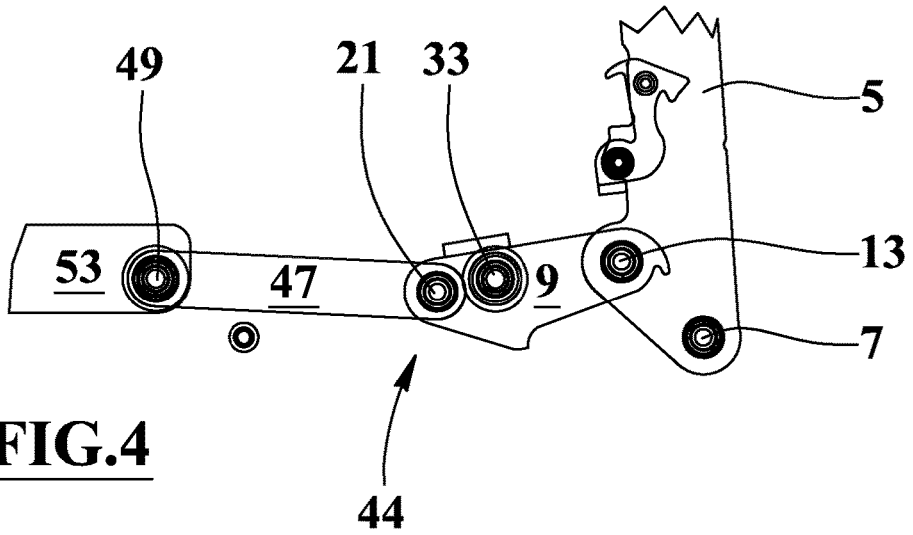
FIGS. 4-6 show partial views of a kinematics chain of the device of FIG. 1 in closed condition partially open and totally open.
Figure 5:
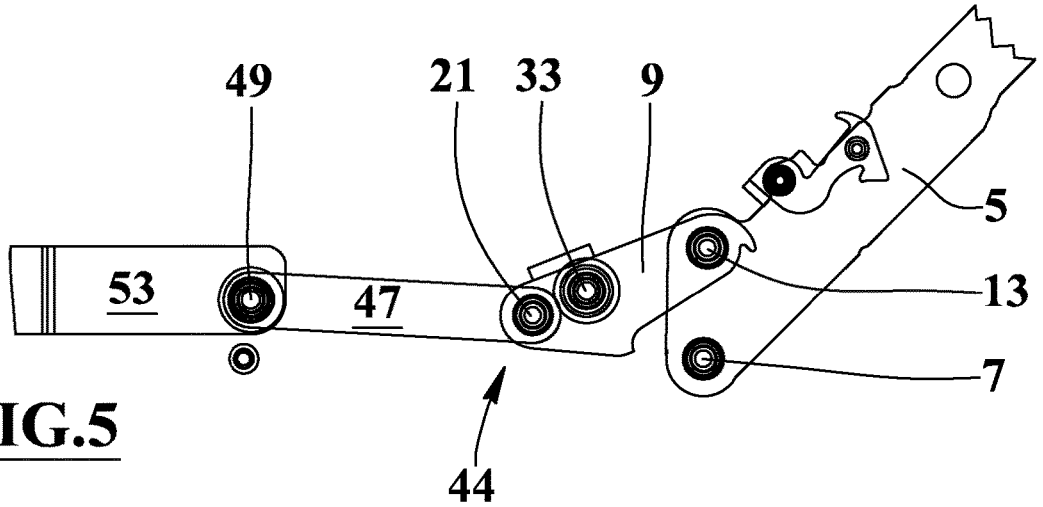
Figure 6:
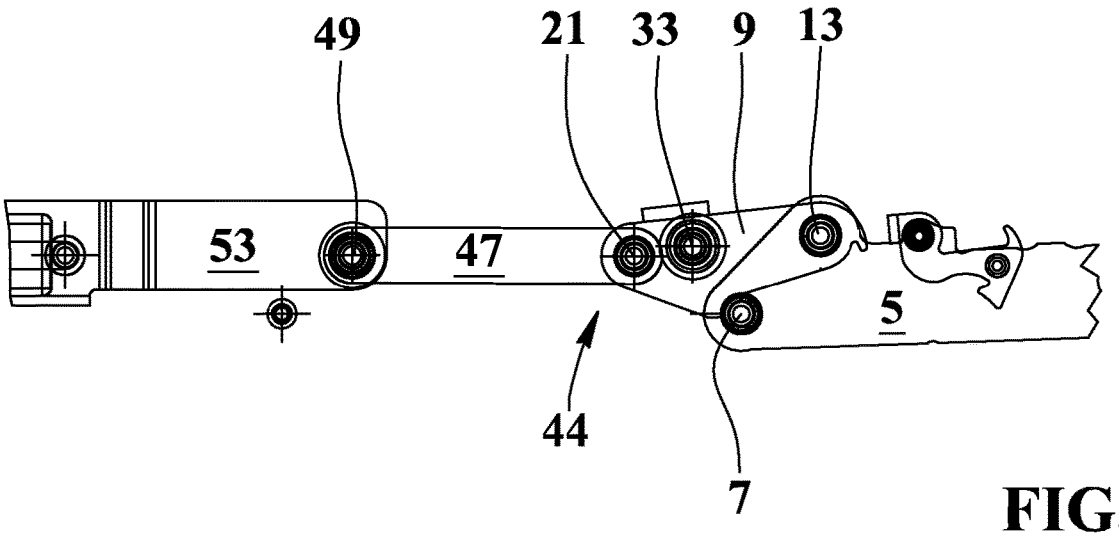

With reference to FIGS. 1-9, numeral 1 indicates the compact hinge device, object of the present invention, assigned to the opening and closing rotation of a door of an appliance, in particular to allow the opening terminal rotation, the intermediate rotation and the closing terminal rotation of the door or vice versa.

The device 1 comprises a first element 3 assigned to be fixed to a body of the apparatus and a second element 5 assigned to be fixed to the door of said apparatus.

In an assembled condition of the device, the first 3 and second 5 elements are mutually connected by means of a hinge pin 7 engaged in respective hinge seats 6, 8, 10 formed in corresponding ends of the first 3 and second 5 elements, guaranteeing the possibility of the door rotation between the opening and the closing or vice versa, around an axis of rotation consisting in the longitudinal geometric axis of said hinge pin 7.

The apparatus may consist on a piece of furniture or furniture/appliance, on a device for industrial or artisan use, in a household appliance, in particular it is suitable for use in domestic ovens since the dimensions of the device are very small and it is also installable in such built-in ovens, integrated with the cookers or of another type.

Said device 1 comprises a rocker means 9 having, at its first end, a first coupling seat 11 connected, by means of a first junction pin 13, to a first junction seat 15 formed in the second element 5 and placed at a certain distance from the respective hinge seat 6 for the hinge pin 7.

The rocker means 9 second end, opposite to the first, carries a second coupling seat 19 connected, by means of a second junction pin 21, to a corresponding second junction seat 23 formed at one end of a tie rod means 25 onto which elastic means 27 acts with an elastic force whose directrix intersects or almost intersect the hinge pin 7 and it is directed in the opposite direction to the latter 7.

An intermediate portion of the rocker means 9, comprised between the first coupling seat 11 and the second coupling seat 19, carries a fulcrum seat 31 for a fulcrum pin 33.

The opposite ends of the second junction pin 21 of the rocker means 9 are protruding and are slidably engaged at least along a cam profile 35 of a respective first slot 37 made in the first element 3 or fixed thereto.

The various seats for the pins may consist of through cylindrical bores made in the parts carrying thereof, and having diameters approximately corresponding to those of the respective pins housing thereof; alternatively, the bores of the seats may be of greater diameter to accommodate respective rotation bushes of the corresponding pins, fulcrums and the like.

The rocker means 9 is constituted by one or, as shown in the enclosed figures, preferably two equal flat almost rectilinear plates. The geometrical axes of the first junction pin 13, of the second junction pin 21 and of the interposed fulcrum pin 33, lie, or nearly so, on the same geometrical lying plane which is perpendicular to the geometrical rotation plane of the second element 5 and parallel to the hinge pin 7.

One of the two parallel plates of the rocker means 9 is placed on one side of the second element 5 and of the tie rod means 25 portion carrying the second junction seat 23, the other plate, parallel and spaced from the previous one, is placed to the opposite side of such second element and tie rod portion.

The first element 3 comprises an elongated first box member 41, for example with an approximately "U" shaped cross-section and made of cut or die-cut and folded metal sheet, containing, at least partially, the rocker means 9, the tie rod means 25 and the elastic means 27 whose ends are connected respectively to one end of the tie rod means 25 and to the end of the first box member 41 opposite to its end which bears a pair of own side hinge seats 8 for the hinge pin 7.

The first element 3 further comprises a second box member 43, for example with an approximately "U" shaped cross-section and made of cut or die-cut and folded metal sheet, and contained at least partially in the first box member 41.

One end of the second box member 43 bears a pair of own side hinge seats 10 for the hinge pin 7 and bears two respective first side and shaped slots 37, for example as an "S", each for the sliding of respective end of the fulcrum pin 33 projecting from the rocker means 9.

Alternatively, the first slots 37 can be formed in or fixed to the first box member 41.

Preferably, the second box member 43 furthermore bears a pair of respective side and rectilinear guide slots 51 for the sliding of the ends of a guide pin 49. The guide slots are separated and spaced from the first slots 37. Alternatively, the side guide slots 51 can be formed in or fixed to the first box member 41.

The tie rod means 25 comprises a connecting rod means 47, one end of which bears the second junction seat 23 and the opposite end bears a seat for said guide pin 49 whose protruding ends slide along the respective guide slots 51 parallel to the directrix of the elastic means 27 elastic force. Alternatively or in addition to the rigid connecting rod means, the tie rod means 25 can comprise a flexible element, for example a chain or a cable.

The guide pin 49 is connected to the elastic means 27, of the drawing spring type or the like, directly or, preferably as illustrated in the figures, by means of a cradle means 53 interconnected between the connecting rod means 47 and the elastic means 27 and slidably contained, at least partially, in the first box member 41 and/or in the second box member 43.

The rocker means 9 and the tie rod means 25 constitute a transmission element 44 that cooperates with the cradle means 53 to provide a kinematics chain that connects the elastic means 27 to the second element 5.

As an alternative to the rocker means 9 and to the tie rod means 25, the invention provides that the transmission element 44 can be constituted by a single rigid or flexible element, for example a steel or textile cable or a small chain, which connects the end of the elastic means 27, opposite to that fixed to the first box member 41, to the first junction seat 15 of the second element 5 or provides that the transmission element 44 is constituted by a set of pulling and/or connecting rods and/or rocker elements or similar, in a number greater than two.

The cradle means 53, preferably made of one or two parts of cut or die-cut and folded metal sheet, contains a dumping means 57, of cylindrical linear type and piston with protruding rod; whose each ends abut on a respective transverse pin 58 whose ends slide into respective side slots 54 carried out in the cradle means 53 and in the respective side slots 42 carried out in the first box member 41.

During the opening and closing of the door, the cradle 53 slides into the first box member 41; the slots for the sliding of the transverse pins' ends of the damping means 57 are positioned and sized and placed in phase to damp at least the opening and/or closing terminal rotation.

In the following, the terms distal and proximal are used with reference to the hinge pin 7 so that these relative terms indicate the greatest distance from or proximity to the hinge pin 7 of an element with respect to another.

During the terminal closing rotation of the door, the cradle means 53 translates away from the hinge pin 7 and the transverse pin 58 of the damper means 57 distal end abuts with one end of the distal slots 42 of the first box member 41 blocking this damper means distal end while the opposite pin 58, corresponding to the damping means proximal end, abuts with one end of the proximal slots 54 of the cradle means which also draws into its motion the pin and the damper means proximal end too, compressing it and therefore braking the door closing terminal rotation motion; even during the terminal door opening rotation, mutatis mutandis, the matching of the transversal pins with the slots induces the damping means compression causing a slowing down of the terminal opening rotation while, during the terminal rotation motion, the transverse pins are free to slide into the slots and there is no damping means compression and the door rotation is not braked.

It is obviously possible to position and size such slots 42, 54 so as to have compression of the damping means 57 and slow down of the rotation only in the terminal opening or closing section and for respective angular extensions which can be determined by means of suitable positioning and sizing of the slots and the damping means.

It should be noted that the shape and the size of the rocker means 9, the pins mutual positions and most of all the shape of the cam profiles 35 of the shaped first slots 37 may correspondingly modulate the elongation of the elastic means 27 spring and then the force exerted by this spring on the door and can vary the action arms with which this force is transmitted; it is therefore possible to adjust and modify these parameters and shapes to modulate the intensity of the torque acting onto the door, to increase for example the torque in correspondence with the closure for a better seal of the seals and/or to increase the closing torque in the closing rotation to balance the weight of the door and/or to create metastable intermediate positions, to allow for example the door to be positioned and kept in an almost closed position for the steam outlet during the grill or spit cooking.

Figure 10:
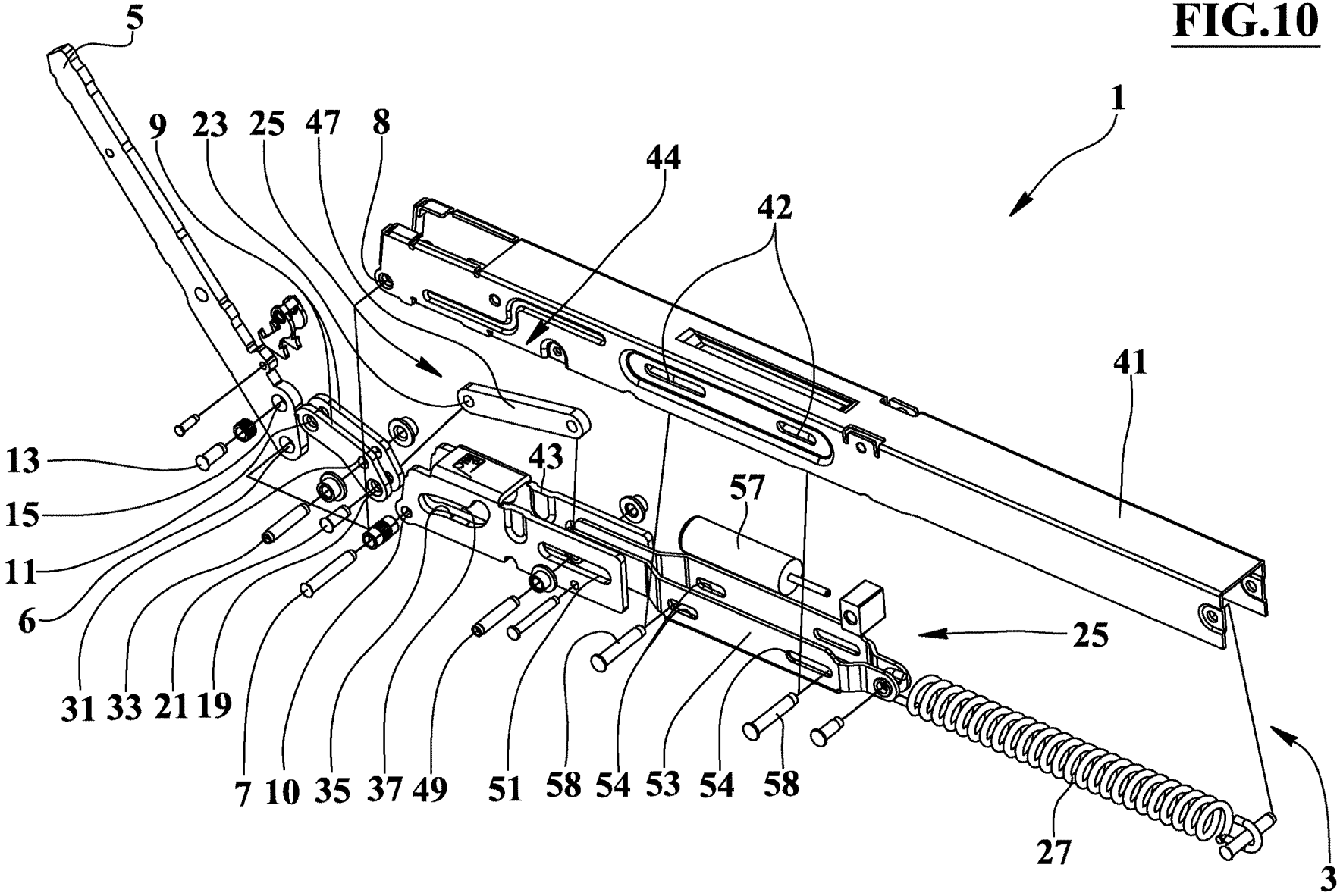
FIG. 10 shows an axonometric and exploded view of a variant of the device of FIG. 1.
Figure 11:
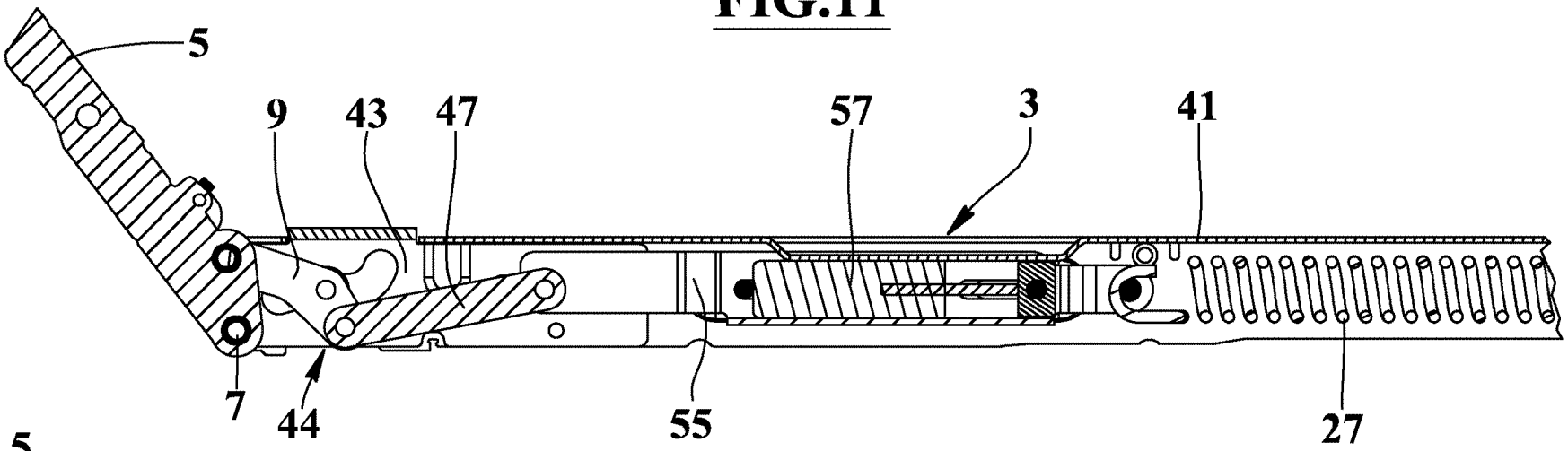
FIG. 11 shows a partial view and sectioned from a longitudinal plane of the device of FIG. 10.
Figure 12:
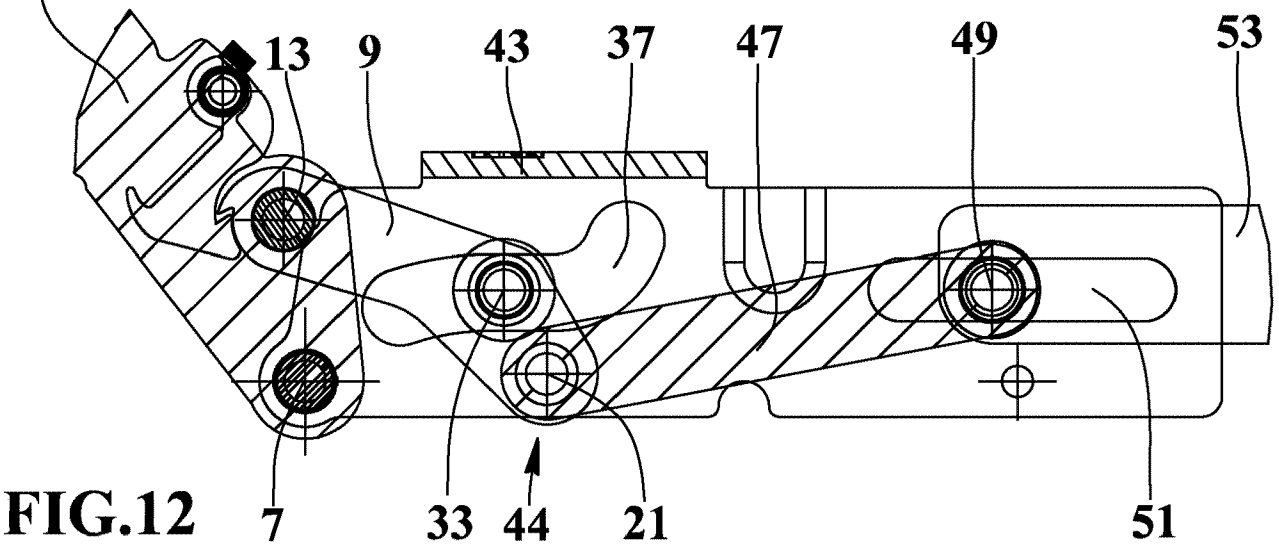
FIG. 12 shows an enlarged view of a detail of FIG. 11.

The device variant of FIGS. 10-15 differs from the preferred embodiment because the rocker means 9 consists of one or two equal flat plates, each consisting of two almost straight arms of different lengths and mutually angled. Alternatively, the straight arms of each plate can be of equal length.

Each plate's fulcrum seat 31 for the fulcrum pin 33 is formed in the angled portion connecting the plate two respective arms or in proximity of said portion.

The invention claimed is:

1. Compact hinge device for the end opening rotation, the intermediate rotation and the end closing rotation or vice versa of a door of an appliance and comprising a first element (3) assigned to be fixed to a body of the appliance and a second element (5) assigned to be fixed to the door of said appliance, where said first (3) and second (5) elements, in an assembled condition, are mutually connected by means of a hinge pin (7) engaged in respective hinge seats (6, 8, 10) carried out at least in the first (3) and second (5) elements for the rotation of the door between opening and closing or vice versa, around a rotation axis of said hinge pin (7); said device (1) being characterized in that it comprises a transmission element (44) interposed between the second element (5) and one end of a cradle means (53) and it comprises elastic means (27) having an end connected to the cradle means (53) end opposite the transmission element (44); the first element (3) comprises an elongated first box member (41) containing, at least partially, the transmission element (44), the connected cradle means (53) and the elastic means (27) whose end opposite to the cradle means (53) is fixed to the first box member (41) transmitting the elastic closing force of said elastic means (27) to the second element (5); said cradle means (53) comprises a damping means (57), of cylindrical linear type and piston with protruding rod, whose each ends abut on a respective transverse pin (58) whose ends slide into respective slots (54) carried out in the cradle means (53) and into respective slots (42) carried out in the first box member (41).

2. Device according to claim 1 characterized in that the slots for sliding the ends of the transverse pins of the damping means (57) are positioned and sized to allow the damping means to damp at least the opening and/or closing end rotation.

3. Device according to claim 1 characterized in that the transmission element (44) comprises at least one rocker means (9) having, at its first end, a first coupling seat (11) connected, through a first junction pin (13), to a first junction seat (15) made in the second element (5) and placed at a certain distance from the respective hinge seat (6) for the hinge pin (7); the rocker means (9) having, at its second end opposite to first end, a second coupling seat (19) connected, through a second junction pin (21), to a corresponding second junction seat (23) carried out at an end of a tie rod means (25) whose opposite end is linked to the cradle means (53) on which said elastic means (27) acts with the elastic force whose directrix intersects or almost intersects the hinge pin (7) and runs in the opposite direction to the latter (7); an intermediate portion of the rocker means (9) has a fulcrum seat (31) for a fulcrum pin (33) having at least one of its ends slidably engaged at least along a cam profile (35) of a respective first slot (37) made in, or fixed to the first element (3).

4. Device according to claim 3 characterized in that the rocker means (9) is constituted by one or two parallel flat plates, each consisting of two almost straight arms of different or same lengths and mutually angled, each plate carries its respective fulcrum seat (31) for the fulcrum pin (33) at or near the angled portion of the plate.

5. Device according to claim 4 characterized in that, in case of rocker means (9) comprising two parallel plates, one of them is on one side of the second element (5) and of the portion of the tie rod means (25) having the second connection seat (23) and the other is at the opposite side of said second element and portion of the tie rod means.

6. Device according to claim 3, characterized in that the ends of the elastic means (27) are connected respectively to one end of the tie rod means (25) and to the one end of the first box member (41); the end of the first box member (41), opposite to the elastic means, having its own pair of hinge seats (8) for the hinge pin (7).

7. Device according to claim 6 characterized in that the first box member (41) furthermore contains, at least partially, a second box member (43) of the first element (3) and having at one end a pair of its hinge seats (10) for the hinge pin (7) and having two respective first side slots (37) each for sliding a respective end of the fulcrum pin (33) projecting from the rocker means (9).

8. Device according to claim 7 characterized in that the tie rod means (25) comprises a connection rod means (47) whose end carries the second junction seat (23) and the opposite end has a seat for a guide pin (49) whose protruding ends slide along respective guide slots (51) parallel to the directrix of the elastic force of the elastic means (27) and formed in or fixed to first element (3).

9. Device according to claim 8 characterized in that the side guide slots (51) are carried out in the second box member (43) of the first element (3).

10. Device according to claim 8, characterized in that the guide pin (49) is connected to the elastic means (27), of a pulling spring type, through the cradle means (53) interconnected between the connecting rod means (47) and the elastic means (27) and slidably contained, at least partially, in the first box member (41) and/or in the second box member (43).

* * * * *